United States Patent [19]

Smith

[11] Patent Number: 4,829,921

[45] Date of Patent: May 16, 1989

[54] PRESSER FOOT FOR A SEWING MACHINE INCLUDING A FULLING ROD AND A TRIMMING KNIFE SLOT

[76] Inventor: Stephen A. Smith, 25 Ledbury Drive, Sharp Lane, Leeds, England, LS10 4BX

[21] Appl. No.: 155,116

[22] Filed: Feb. 11, 1988

[30] Foreign Application Priority Data

Mar. 3, 1987 [GB] United Kingdom ..... 8704896

[51] Int. Cl.[4] ..... D05B 29/12

[52] U.S. Cl. ..... 112/235; 112/151; 112/121.12

[58] Field of Search ..... 112/151, 235, 121.12, 112/262.2

[56] References Cited

U.S. PATENT DOCUMENTS 4,509,440 4/1985 Freermann ..... 112/235 X
4,527,492 7/1985 Gill ..... 112/121.12
4,574,717 3/1986 Junemann et al. ..... 112/121.12
4,644,885 2/1987 Bennison ..... 112/121.12

*Primary Examiner*—Andrew M. Falik

[57] ABSTRACT

A presser foot for a sewing machine comprises a base section (1) through which are formed a needle hole (2) and a trimming knife slot (3) spaced away from the needle hole. A support (4) projects upwardly from the base section, and can be attached to a sewing machine. The lower surface of the base section is formed with a groove (7) extending from a leading edge of the base section between the needle hole and the trimming knife slot and parallel to that slot. A fulling rod (16) lies at least partially within the groove and extends along the groove from the leading section thereof to a point beyond the location of the trimming knife, the fulling rod being secured to the base section in such a way that unobstructed free space is left between the fulling rod and the wall of the groove. The arrangement allows automatic formation of a stepped-back edge between two stitched-together garment sections.

9 Claims, 3 Drawing Sheets

Fig. 6.
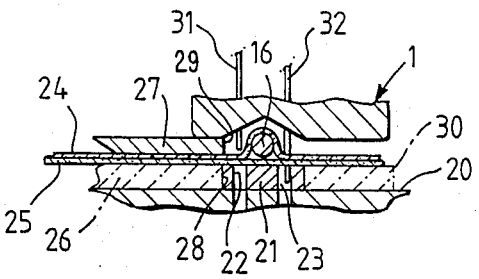
Fig. 7.
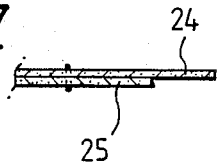
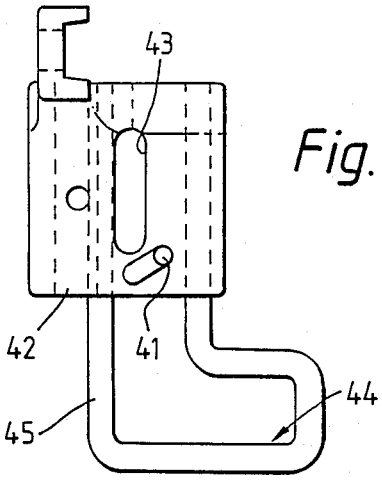
Fig. 8.

PRESSER FOOT FOR A SEWING MACHINE INCLUDING A FULLING ROD AND A TRIMMING KNIFE SLOT

This invention relates to a presser foot for a sewing machine.

BACKGROUND OF THE INVENTION

The mass-production garment industry is now heavily mechanised, and one technique that is commonly used for assembling together two or more garment parts is to use a stitching jig. Such jigs comprise a lower plate and an upper plate between which the garment parts may be held, and fulling means may also be present between the upper and lower plates in order that fullness may be introduced into required areas of the upper fabric layer. The lower plate of the jig has a guide track which, in use, is engaged with a guide member on the base plate of a sewing machine, with the fabric parts to be stitched together overlying the guide track. The guide member has an opening for the needle of a sewing machine and an elongated opening adjacent to the needle opening through which a trimming knife may be reciprocated. In use, the loaded jig is driven so that it moves beneath the needle and trimming knife, with the guide track following the guide member. A line of stitching between the garment parts is effected along the line defined by the guide track, and unwanted material lying outside the stitch line is cut away by the trimming knife. The resulting composite garment part can then be removed from the jig for further processing.

It will be appreciated that the trimming knife cuts simultaneously through all the fabric layers, and thus that the distance from the stitch line t the free edge of each layer will be substantially identical.

In the manufacture of some high quality garments a so-called leaf edge is required, and in order to form such an edge it is a requirement that the trimmed edges of the respective layers of fabric should not be equidistant from the stitch line, but that a first layer of fabric should extend beyond a second layer by a predetermined distance along the whole of the trimmed edge. Thus, the edge of the second layer is substantially uniformly stepped back from the edge of the first layer. The resultant single layer strip of first fabric is necessary in forming the leaf edge. This type of edge can be hand made, but so far as is known there is no equipment available which can automate the cutting of parts so that such an edge can be formed. The invention provides a presser foot for a sewing machine by way of which cutting to give a stepped-back edge can automatically be effected.

SUMMARY OF THE INVENTION

According to the invention a presser foot for a sewing machine comprises a base section through which are formed a needle hole and a trimming knife slot spaced away from the needle hole, and a support projecting upwardly from the base section and capable of being attached to a sewing machine, in which the lower surface of the base section is formed with a groove extending from a leading edge of the base section between tee needle hole and the trimming knife slot and parallel to that slot, and a fulling rod lies at least partially within th groove and extends along the groove from the leading section thereof to a point beyond the location of the trimming knife, the fulling rod being secured to the base section in such a way that unobstructed free space is left between the fulling rod and the wall of the groove.

In use, a stitching jig loaded with the fabric parts to be joined together is presented to the presser foot, a guide track of the jig having already been engaged with a guide member on the base plate of the sewing machine. In the region where stitching is to commence, a free edge of the uppermost ply of fabric held in the jig is separated from the lower ply or plies and presented to the fulling rod so that the uppermost ply lies above the fulling rod and the remaining ply or plies lie below the rod. As the jig is advanced past the needle it will be seen that a degree of fullness is introduced into the upper ply, and that the plies are stitched together on one side of the fulling rod and are trimmed by the trimming knife on the other side of the fulling rod. Once the stitched parts have been removed from the jig and the stitched and trimmed edge has been smoothed so that the plies lie flat one on the other it will be seen that the uppermost ply into which fullness was introduced will project beyond the cut edge of the lower ply or plies so that the cut edge of the lower ply or plies is stepped back from the cut edge of the uppermost ply. Thus, a single layer edge of upper fabric is produced, and the stitched assembly can be used in the formation of a leaf edge.

It is preferred that the groove extends the full length of the base section from the leading edge to the trailing edge thereof, and it is also preferred that the fulling rod extends for at least the full length of the groove. Thus, the required fullness is uniformly held in the uppermost fabric layer through the whole of the zone where the layers are affected by the needle and the trimming knife.

Preferably the fulling rod extends forwardly from the leading edge of the groove in order to facilitate the initial presentation of the fabric to the presser foot with the uppermost fabric layer passing over the fulling rod.

The fulling rod may conveniently be secured to th base section by an extension of the fulling rod, the extension lying clear of the groove. When the rod extends forwardly of the leading edge of the base section then the extension is conveniently in the form of a loop from the forward end of the rod, the loop connecting to the base section. That connection is preferably on the opposite side of the trimming knife slot to the needle hole.

The cross-section and dimensions of the groove and the fulling rod will be designed to produce the desired degree of step-back between the fabric plies. It is presently preferred that the groove be of inverted V cross-section and that the fulling rod have an uppermost part of semicircular cross-section, both those cross-sections being constant throughout the length of the groove and the length of the rod.

The lower section of the rod may also be of semicircular section so that the rod as a whole is of circular cross-section, but if circular section rod is used then it is preferred that part of the lower surface of the rod be cut away to form a flat lower surface at least in that portion of the rod which lies immediately forward of the leading edge of the base section. This will facilitate turning of the jig as corners of the guide track are reached.

Desirably means are provided for directing a stream of compressed air downwardly adjacent to the leading edge of the base section. An air stream in this region will help to hold the top fabric layer in position over the fulling rod, particularly when corners are being negotiated.

BRIEF DESCRIPTION OF THE DRAWINGS

In order that the invention may be better understood specific embodiments of presser feet in accordance therewith will now be described in more detail, by way of example only, with reference to the accompanying drawings in which:

FIG. 6 illustrates the presser foot in use;

FIG. 7 illustrates a fabric assembly formed by the presser foot; and

FIG. 8 is a top plan view of a second embodiment of presser foot.

DESCRIPTION OF A PREFERRED EMBODIMENT

Figure 1:
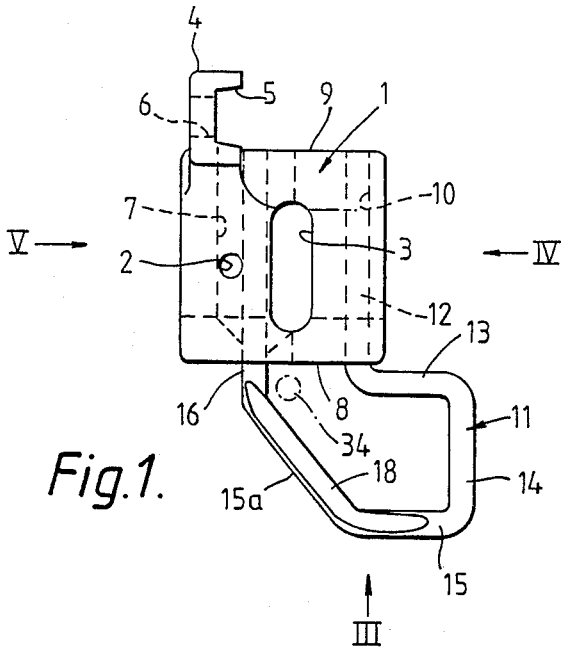
FIG. 1 is a top plan view of a first embodiment of presser foot.

The presser foot shown in FIG. 1 may be scratch made, or may be made by modifying a conventional presser foot. The conventional foot has a base section 1, through which are formed a needle hole 2 and a slot 3 for receiving a trimming knife. A support 4 projects upwardly from the base section and has a channel 5 by way of which the support may be engaged with the presser shaft of a sewing machine, the support being secured to the shaft by a bolt passing through an opening 6.

The presser foot is modified by forming a groove 7 of inverted V shaped cross-section along the full length of the underside of the presser foot from the leading edge 8 to the trailing edge 9 thereof and parallel to the slot 3. Additionally, a bore 10 is drilled through the full length of the presser foot, also parallel to the slot 3, and part of a circular section rod 11 is secured in the bore 10, for example by a suitable adhesive.

Figure 2:
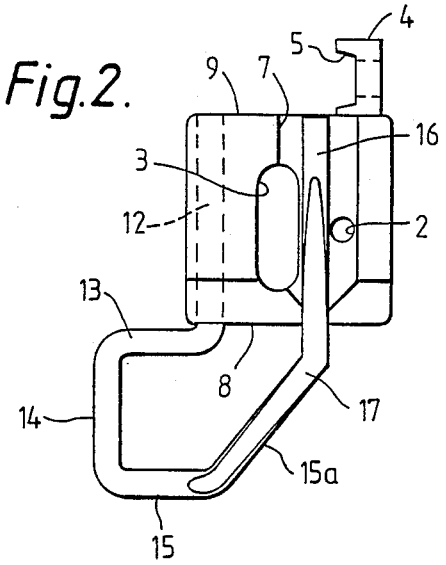
FIG. 2 is a bottom plan view of the foot of FIG. 1.
Figure 3:
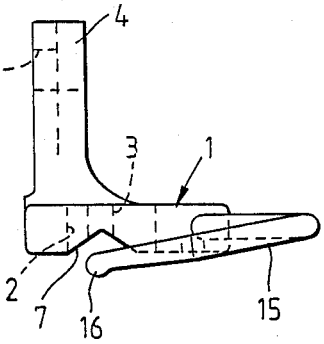
FIG. 3 is an end elevation in the direction of the arrow III in FIG. 1.
Figure 4:
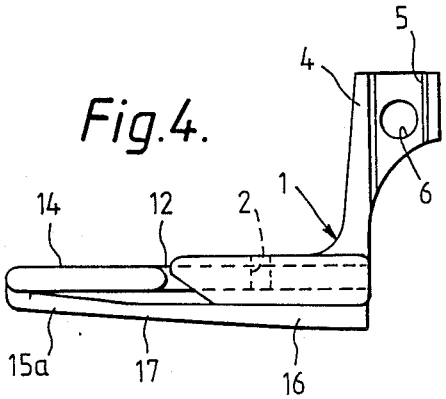
FIGS. 4 and 5 are respective side elevations in the directions of arrows IV and V in FIG. 1.
Figure 5:
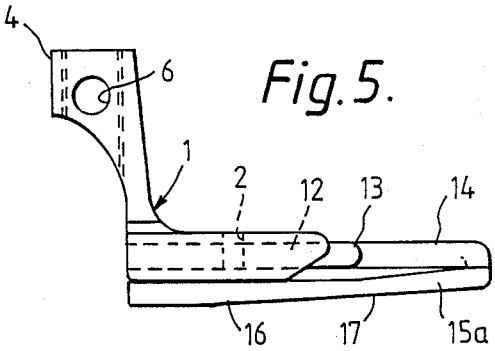

The rod 11 has a first mounting section 12 which actually fits within the bore 10 and extends forwardly thereof, an outwardly turned second section 13 and a third section 14 extending parallel to the section 10. The rod is then bent to form a further section 15 that extends inwardly and downwardly, and that merges into a diagonally and rearwardly extending section **15*a* and then into a rearwardly extending section 16 which constitutes fulling rod. The fulling rod extends from forwardly of the leading edge 8 of the base section, along the groove 7, to the trailing edge 9 of the base section. The upper half of the fulling rod 16 is of constant semicircular cross-section and it will be seen from FIG. 2 that this is spaced from the walls of the groove 7** so that unobstructed free space is left between the walls of the groove along the full length of the groove.

The lower half of the forward part of the fulling rod has a flattened lowermost region 17 that also extends along the lower half of the diagonal section **15*a*. The upper half of section 15*a* also has a flattened uppermost region 18, which extends into the upper region of section 15**.

In use, the presser foot is secured to an industrial sewing machine in conventional manner, so that the needle of the machine may pass through the needle hole 2 and the trimming knife of the machine may pass through the slot 3. The base plate 20 of the machine (FIG. 6) is formed with an upstanding guide member 2 which is also formed with a needle hole 22 and with a slot 23 for the trimming knife. Upper and lower layers 24 and 25 of fabric that are to be stitched together are loaded into a stitching jig comprising a lower plate 26 and an upper plate 27 and are held in the jig by engagement of the plates. The jig may incorporate fulling means as is well known in this art. The lower plate 26 of the jig is formed with a guide track 28, and the upper plate 27 terminate in a free edge 29 which overlies one edge of the guide track. The outer edge 30 of the lower plate is shaped to a profile corresponding to the guide track, and can be engaged by driving means (not shown) on the sewing machine in order to move the jig relative to the needle.

The loaded jig is presented to the machine and the track 28 is engaged over the guide 21 in the region where stitching is to commence. The upper layer 24 of fabric is separated from the lower layer 25 and the layers are arranged so that the lower layer remains beneath the fulling rod 16 while the upper layer passes over the fulling rod 16. Accordingly, fullness is introduced into the upper fabric layer between the region of the needle 31 and of the trimming knife 32. Stitching and simultaneous trimming can now commence, the jig being advanced through the machine beneath the presser foot, which holds the jig plates in their closed relationship with the fabric clamped firmly therebetween. A line of stitching is formed to one side of the fulling rod 16, while the excess fabric is cut away to the other side of the fulling rod 16.

When stitching has been completed the stitched assembly is removed, and if the stitched and trimmed edge of the assembly is smoothed out it will be seen (FIG. 7) that the upper fabric layer 24 overlaps the cut edge of the lower fabric layer 25 by a distance dependent on the amount of fullness introduced by the fulling bar 16.

The required set-back relationship between the fabric edges has thus been achieved and the fabric assembly can be used in the formation of a leaf edge. The invention thus makes possible the automatic manufacture of fabric assemblies for forming this type of edge.

The flattened sections 17 and 18 on the fulling rod and its support sections are not essential, but their presence is helpful in avoiding or at least mitigating distortion of the lower fabric ply as the jig is being turned to negotiate corners in the guide track.

As there may be a tendency for the upper fabric layer to lift as it passes beneath the presser foot it can be helpful to direct a stream of compressed air downwardly onto the fabric in the region of the leading edge of the base section. This could, for example, be by way of a pipe from the air system of the sewing machine, terminating in the region indicated at 34 in FIG. 1.

In an alternative arrangement, shown in FIG. 8, a compressed air tube 41 may be secured to the base section 42 of the presser foot to feed air through a hole formed in the base section ahead of the knife slot 43. The foot shown in FIG. 8 is otherwise generally similar to that of FIG. 1, but with a somewhat differently shaped support arrangement 44 for the fulling bar 45.

It will be appreciated that the presser foot may be modified in a number of other ways, for example in the cross-section of the groove and of the fulling rod and in the method of connection of the fulling rod to the base section. That connection may take any form that will not interfere with the free passage of the loaded jig beneath the presser foot as stitching is taking place.

I claim:

1. A presser foot for a sewing machine, the foot comprising a base section though which are formed a needle hole and a trimming knife slot spaced away from the needle hole, and a support projecting upwardly from the base section and capable of being attached to a sewing machine in which the lower surface of the base section is formed with a groove extending from a leading edge of the base section between the needle hole and the trimming knife slot and parallel to that slot, and a fulling rod lies at least partially within the groove, and extends along the groove from the leading section thereof to a point beyond the location of a trimming knife, the fulling rod being secured to the base section in such a way that unobstructed free space is left between the fulling rod and the wall of the groove.

2. A presser foot according to claim 1 in which the groove extends the full length of the base section from the leading edge to the trailing edge thereof.

3. A presser foot according to claim 1 in which the fulling rod extends for at least the full length of the groove.

4. A presser foot according to claim 1 in which the fulling rod is secured to the base section by an extension of the fulling rod, the extension lying clear of the groove.

5. A presser foot according to claim 1 in which the fulling rod extends forwardly from the leading end of the groove.

6. A presser foot according to claim 5 in which the fulling rod is secured to the base section by an extension in the form of a loop from the forward end of the rod, the loop connecting to the base section.

7. A presser foot according to claim 6 in which the loop is connected to the base section on the opposite side of the trimming knife slot to the needle hole.

8. A presser foot according to claim 1 in which the groove is of inverted V cross-section and the fulling rod has an uppermost part of semi-circular cross-section, both those cross-sections being constant throughout the length of the groove and the length of the rod.

9. A presser foot according to claim 8 in which the lower surface of the fulling rod is flat in at least that portion of the rod which lies immediately forward of the leading edge of the base section.

* * * * *